US005390522A

United States Patent [19]

Dircks

[11] Patent Number: 5,390,522

[45] Date of Patent: Feb. 21, 1995

[54] TANDEM ROLLER PIPE BENDER

[76] Inventor: Robert A. Dircks, Carroll Gap, Somerton, New South Wales 2340, Australia

[21] Appl. No.: 175,472

[22] Filed: Dec. 28, 1993

Related U.S. Application Data

[63] Continuation of Ser. No. 786,086, Oct. 31, 1991, abandoned.

[30] Foreign Application Priority Data

Oct. 31, 1990 [AU] Australia ..... PK3110
Aug. 16, 1991 [AU] Australia ..... PK7805

[51] Int. Cl.[6] ..... B21D 7/024
[52] U.S. Cl. ..... 72/217; 72/218
[58] Field of Search ..... 72/217, 218, 219, 149, 72/388, 387, 150

[56] References Cited

U.S. PATENT DOCUMENTS

| | | | |
|---|---|---|---|
| 2,346,371 | 4/1944 | Fink | 72/219 |
| 2,620,848 | 12/1952 | Paoli | 72/217 |
| 2,656,872 | 10/1953 | Mann et al. | 72/219 |
| 2,754,880 | 7/1956 | Kuehlman et al. | 72/158 |
| 3,236,082 | 2/1966 | Beck et al. | 72/149 |
| 3,380,283 | 4/1968 | Wilson et al. | 72/387 |
| 3,613,430 | 10/1971 | Crees | 72/388 |
| 3,949,584 | 4/1976 | Pearson et al. | 72/149 |
| 4,012,933 | 3/1977 | Porter | 72/217 |
| 4,938,050 | 7/1990 | Kimura | 72/217 |

FOREIGN PATENT DOCUMENTS

| | | | |
|---|---|---|---|
| 0627885 | 10/1978 | U.S.S.R. | 72/149 |
| 0884789 | 11/1981 | U.S.S.R. | 72/217 |

OTHER PUBLICATIONS

Greenlee Brochure—Bulletin-IM-909—Rev No. 14.

*Primary Examiner*—David Jones
*Attorney, Agent, or Firm*—Ladas & Parry

[57] ABSTRACT

A pipe bender 100 comprises a base 111, a former 132 on the base and having a former surface extending angularly at a fixed radius about a bending axis 114. The former surface is provided to engage a length of pipe 134 to be bent to conform to at least a portion of the length of the former surface. A bending arm 113 is pivotally mounted on the base 111 for pivoting movement about the axis 114. A bending assembly 115 is mounted on the arm 113 and includes two deforming rollers 122, 123 rotatably mounted for movement about an axis which is parallel to the bending axis 114 and spaced radially outwardly of the bending surface. The rollers 122, 123 are adapted to engage the length of pipe 134 to cause bending thereof as it is moved angularly about the axis 114. The rollers 122, 123 are substantially co-extensive, with one of the rollers being positioned radially with respect to the bending axis 114 so that in use the one roller is positioned at approximately the bending point of the pipe, the other roller being spaced angularly forward of the one roller and radially further from the bending axis 114 than one roller. A hydraulic ram 126 is provided to cause angular movement of the arm 113 about axis 114 to thereby move the roller and deform the pipe.

9 Claims, 9 Drawing Sheets

TANDEM ROLLER PIPE BENDER

This is a continuation of application Ser. No. 07/786,086, filed on Oct. 31, 1991, abandoned.

FIELD OF THE INVENTION

The invention pertains to pipe bending and more particularly to an apparatus and method for bending pipe using at least two means for exerting pressure against an inside former.

BACKGROUND OF THE INVENTION

There are many known apparatuses for pipe bending, each with its own particular method of use and each with its own limitations. Certain features are commonly considered to be unacceptable in a bent section of pipe. Kinking of the surface of the section is usually found on the inside of the bend. It is considered a major fault Wrinkling of the surface of this section is also usually found on the inside of a bend. Wrinkling is like small but repeated kinks and is often not acceptable. Distortion of the original shape of the cross-sectional profile in the form of a flattening found at the outside of the bend is sometimes acceptable if only minor by visual inspection. Marks, dents or bulges left in the surface of the section by the bending apparatus is usually considered a minor fault from a mechanical standpoint but may be very significant in a visual sense.

In recent times, pipe and RHS have been available in C350 grade steel, which is stronger than previously supplied steels. This grade of steel is work hardened when it is cold formed into pipe. It is also welded at the seam by electric resistance welding. The resulting pipe and RHS section is stronger and much more resistant to deformation. However bending is itself a form of controlled deformation. Further, sections are now offered with thinner wall thicknesses to give a section of similar strength lower weight than previous sections. While the strength, section thinness and lower weight may be advantagous to most users, problems involving all of the bending faults mentioned above are encountered when using conventional bending devices which were designed for sections produced by prior means.

Most existing pipe benders use a rigid, curved former which controls both the cross-sectional profile of the section and the radius of the bend. One simple type of bender users two fixed posts to apply a reaction force, while the inner former is forced into the pipe section between the posts to create the bend. The bend starts at the centre and progresses in both directions along the section as the former is progressively advanced between the posts. This type of bender is usually referred to as a "fixed post bender". Because the reaction points are widely spaced (to allow the former to pass between them) the force applied is relatively low allowing easy bending. However, high former contact pressure is desireable to prevent wrinkling of the bend, particularly with C350 grade sections which are in use today. Severe kinking is usually experienced with C350 grade pipe in conventional formers with a radius of bend of approximately three times the diameter of the pipe. There have been attempts to avoid this by increasing the former radius from three diameters to four diameters and by making the former tighter on the pipe, even to the point of having the pipe squeeze into the former. It is intended that this grip in the former will stop the pipe rising out of the former at the point of bend and allow a kink to form. These measures are successful on some types of pipe and in most cases kinking is not found while flattening and wrinkling are only minor.

However, many users do not like the swept bend appearance of a four diameter bend as it affects design from both a mechanical point of view as well as aesthetic considerations. Also, variations in pipe quality, bending technique and former specifications all cause serious bending faults.

A fairly recent variation of the fixed post bender allows the reaction points to be kept fairly close to the point of bend while also providing for them to move outward as bending progresses. This is done by mounting a roller on each of two pivotting arms. The arms move apart as the former is driven between them. However, this method still results in some problems with extra light wall sections where some wrinkling still occurs and outside flattening is noticeable.

Certain more effective and also more complex and expensive benders are referred to as draw benders. They are arranged to start the bend at a predetermined point and progressively bend this section around a former in one direction only. This is usually done by providing a fixed inside former, with one reaction point also fixed. Bending is achieved by a sliding or rolling outside former following an arc concentric with the inside former's shape. This allows the reaction point to be kept relatively close to the actual point of bend at all times and high former contact pressure is maintained. This tends to minimise wrinkling. However, with some extra light wall sections, wrinkling is still encountered with considerably flattening around the outside of the bend.

Draw benders are usually arranged to make a bend progressively in one direction from a start point, by engaging the pipe to be bent between a fixed reaction point, a fixed inside former and a movable outside member which is attached pivotally at the centre of the fixed former. Some variations use a fixed outside member and an inside former and clamping reaction member that rotate together pulling the pipe around the bend.

On fixed inside former types the outside member is usually a shaped roller that moves at a constant radius to the fixed inside former which has a curved groove to shape and support the pipe as it is bent. Sometimes the outside member is a flat roller with a shaped straight outside former to distribute the bending force over a length of the pipe to avoid deformation of the pipe surface by a concentrated point of contact from a roller alone.

To load the pipe into the bender ready for bending the pipe can be slid between the three members but this is very awkward, even impossible if a series of bends are to be made on one pipe close to each other. For ease of use the outside member is moved away from the former far enough to allow the pipe to be lowered to the plane of bending and moved into the former groove. Then the outside member must be moved closer to the former again for bending. After bending the outside member must be moved away again to unload the pipe.

This movement is usually achieved by mounting the outside member in a carriage which has its position adjusted along the radial arm by a screw thread and handle. This means can introduce two problems; that it is awkwardly slow to operate, and that it does not accurately bring the outside member to the same radial position for all bends in a series of bends that may be required to be the same. In some industrial bending apparatus the carriage is moved radially in relation to the former by a hydraulic cylinder or other linear actuator. This is very expensive to arrange and physically large, making such benders only suitable for industry producing large volume runs of products using bent pipe.

OBJECT AND SUMMARY OF THE INVENTION

It is an object of the invention to substantially ameliorate some of the disadvantages associated with prior art pipe benders.

There is disclosed herein a pipe bender comprising:

a base;

a former mounted on the base and having a former surface extending angularly at a fixed radius about a bending axis, said former surface being provided to engage a length of pipe to be bent to conform to at least a portion of the length of said former surface;

a bending arm pivotally mounted on said base for pivotting movement about said axis;

a bending assembly mounted on said arm, said assembly including two deforming rollers rotatably mounted for movement about an axes parallel to said bending axis, and spaced radially outwardly of said surface, said rollers being adapted to engage said length of pipe to cause bending thereof as it is moved angularly about said axis;

said rollers being substantially co-extensive with one roller being positioned radially with respect to said bending axis so that in use said one roller is positioned at approximately the bending point of the pipe, the other roller being spaced angularly forward of said one roller and radially further from said bending axis than said one roller; and motor means to cause angular movement of said arm about said axis to thereby move said roller to deform said pipe.

BRIEF DESCRIPTION OF THE DRAWINGS

A preferred form of the present invention will now be described by way of example with reference to the accompanying drawings wherein.

BEST MODE AND OTHER EMBODIMENTS OF THE PRESENT INVENTION

Figure 1:
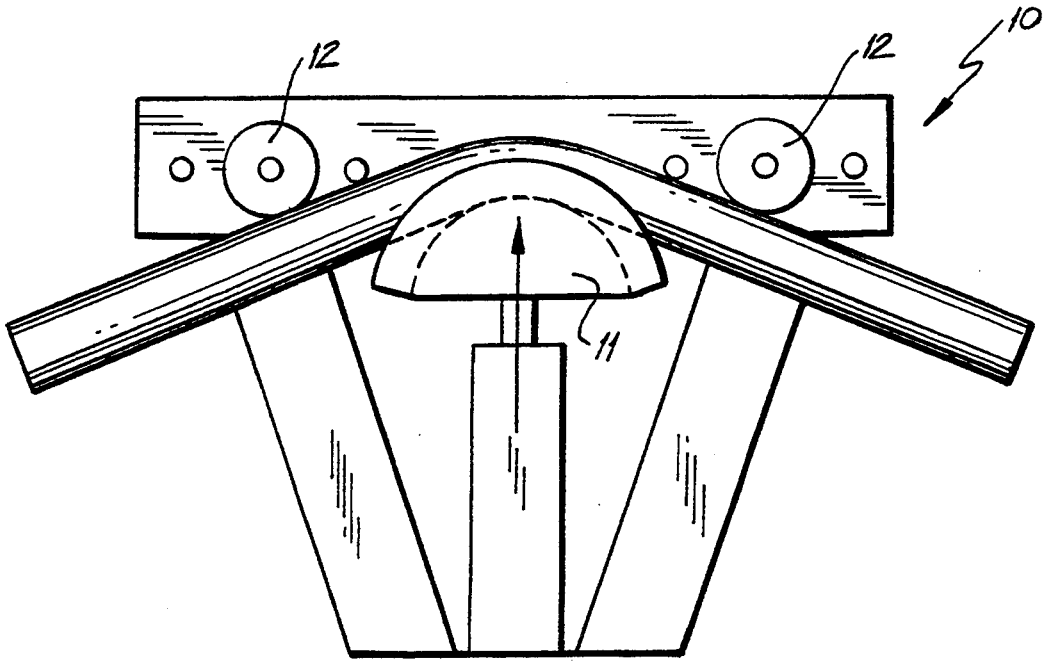
FIG. 1 PRIOR ART
FIG. 1 is a front elevation of a prior art fixed post bender.
Figure 2:
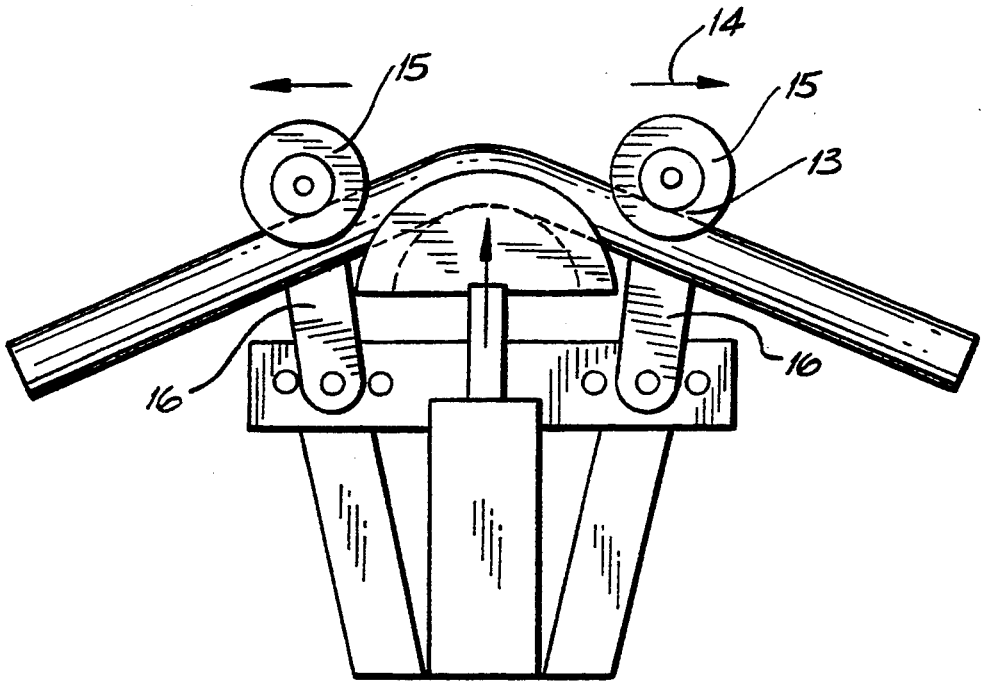
FIG. 2 PRIOR ART
FIG. 2 is a front elevation of a prior art bender with pivotted arms.
Figure 3:
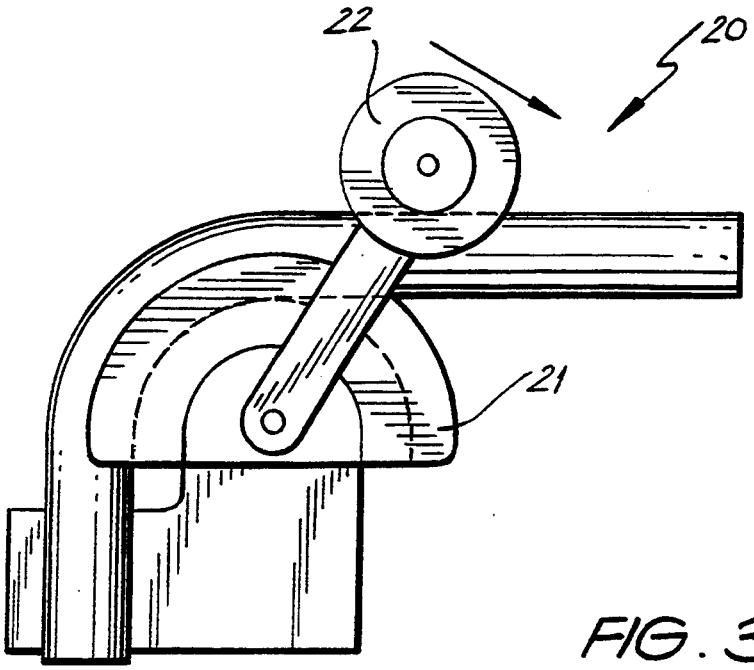
FIG. 3 PRIOR ART
FIG. 3 is a front elevation of a prior art draw bender.
Figure 4:
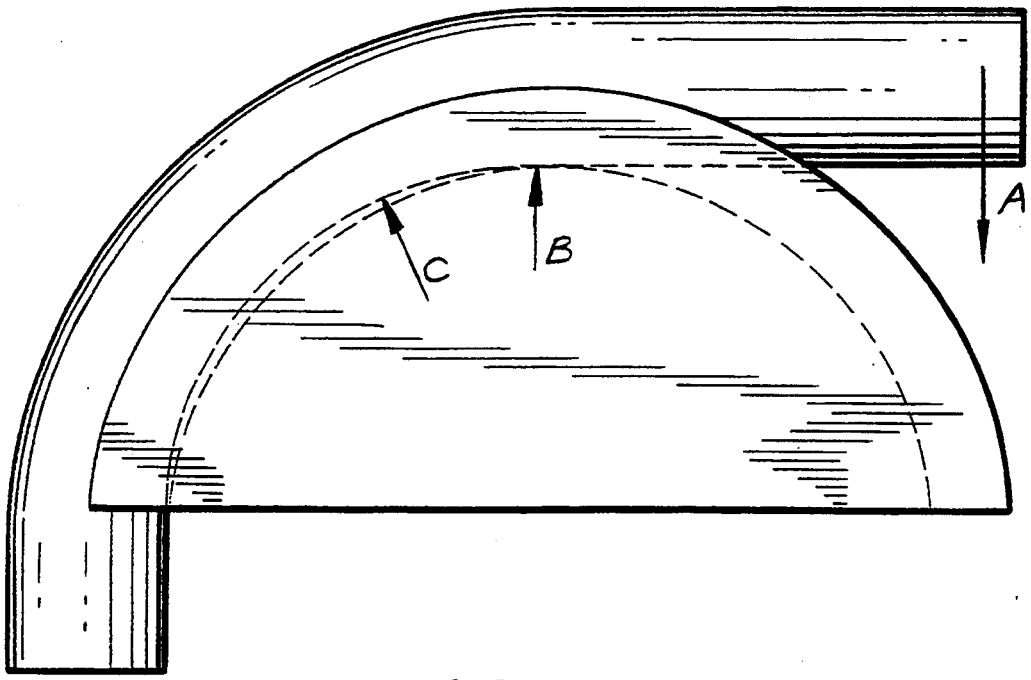
FIG. 4 PRIOR ART
FIG. 4 is a front elevation illustrating a source of defects in conventional pipe benders.

As shown in FIG. 1, a conventional fixed post bender 10 uses a rigid, curved former 11 which controls both the cross-sectional profile of the section and the radius of the bend. Fixed posts 12 are set apart while the former 11 is forced into the section between the posts to create the bend. FIG. 2 illustrates a variant of a conventional fixed post bender which allows the reaction points 13 to be kept fairly close to the point of the bend while also allowing them to move outwards (in the direction of the arrows 14) as bending progresses. This is done by mounting rollers 15 on each of two pivotted arms 16. FIG. 3 illustrates a prior art induction bender 20. A fixed inside former 21 cooperates with a sliding or rolling outside former 22. Each of these prior devices has been briefly described and their limitations partially discussed in the BACKGROUND OF THE INVENTION. It is believed that wrinkling occurs in these and other devices because the actual point of bend can lag behind the point of maximum contact pressure. This causes the pipe or section being formed to be lifted out of the inside former by leverage from the reaction point and the point of maximum contact pressure. This concentrates the bend momentarily until a new bend point is established at the contact point. The cycle continues, thus causing wrinkles. This is shown in FIG. 4, wherein A represents the reaction point, B represents the point of maximum contact pressure and C represents the point of bending.

Figure 5:
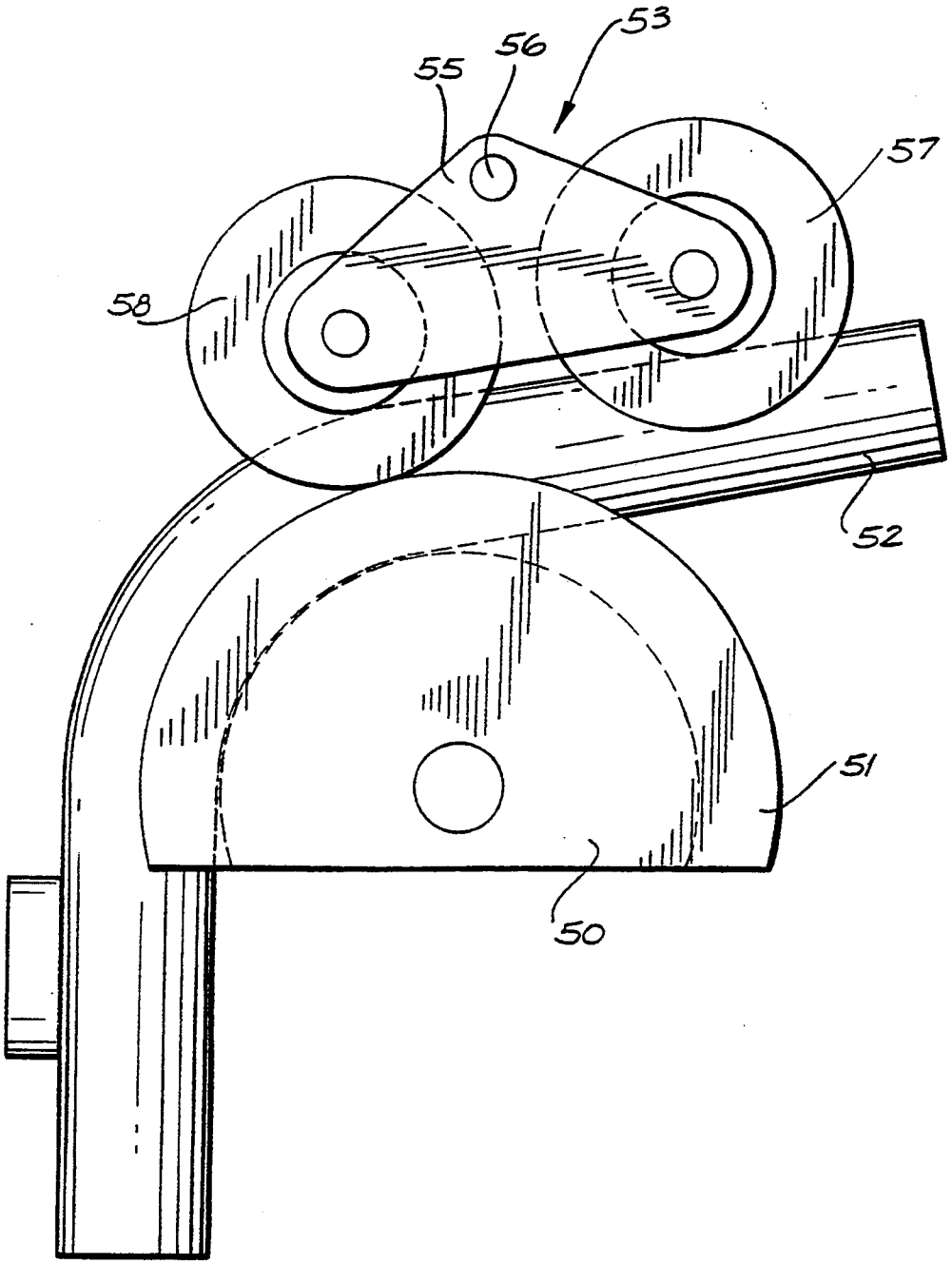
FIG. 5 is a front elevation of a tandem roller pipe bender according to the teachings of the present invention.

It is possible to avoid the cycle of wrinkle formation by providing a second point of contact pressure at the point of bend. A device for achieving this result is illustrated in FIG. 5. As shown in FIG. 5, an inside former 50 includes a peripheral channel 51 which conforms to the shape of the section 52 being bent. Generally, the section 52 will be a round pipe and the cross-section of the channel 51 will correspond to about one half of the circumference of the pipe. However, it should be appreciated that the teachings of the present invention are not limited to bending of round pipes.

The inside former 50 works in cooperation with an outside former 53. The outside former 53 comprises at least two means for exerting pressure on the section 52. For the purpose of the present example, the means for exerting pressure are rollers 57, 58. However, the means need not be rollers, as sliding shoes or various other pressure exerting devices could be used in place of the rollers 57, 58. The rollers 57, 58 are mounted on a pivotting cradle 55. The cradle 55 pivots about an axis 56. Preferably, the rollers 57, 58 have concave peripheral grooves or channels which match the profile of the section being bent. Because the cradle is pivotting, the reaction force exerted against the first roller 57 is reflected or transmitted to the second roller 58 which is located at or near the point of bend. This keeps the pipe or material at the point of bend fully seated in the inside former 50, thus prevent the point of bend from lagging the point of maximum pressure. Thus, bending will be continuous without the wrinkle cycle being encountered. One advantage of this system is that the grip of the inside former 50 is not relied upon to keep the material at the point of bend seated. Because former squeeze is not required, the profile shape of the formers is less critical. By reducing the inside former coverage to one half pipe diameter and having the point of bend outside former 53 with half pipe diameter coverage also, the profile of the pipe will be fully contained at the point of bend and outside flattening will be minimized. This allows former radius to be reduced while maintaining a good quality of bend on a wide range of sections.

It can be appreciated that the first roller 57 applies the bending force as a moment and that the second roller 58 applies a force to the material to contain and control the shape of material in the inside former 50. It is preferred that the second roller 58 be located at or near the point of bend. The second roller 58 need not be located precisely at the point of bend. In a preferred embodiment, a gap of several millimeters is left between the outside diameter of the second roller 58 and the outside diameter of the inside former 50. This ensures that the pressure exerted by the second roller 58 is also exerted onto the section or pipe being bent and not transmitted directly onto the inside former 50.

The distance separating the two rollers could vary greatly so that the contact they have with the material being bent could be very close or quite distant. Further, the two rollers, while preferably mounted on a common pivotting cradle 55, could be moved into and out of position by separate means. Hydraulic, pneumatic, electrical, magnetic or mechanical devices can be used to move each roller into and out of position independent of the other roller. In this regard it should also be noted that the pivot axis 56 of the cradle 55 can be moved relative to the rotational centres of the outside formers to as to vary the geometry and hence the contact pressure exerted by the second roller 58.

It should be appreciated that the advantages of the present invention are obtained regardless of whether the rollers and cradle 55 rotate with respect to the centre of the inside former or whether the former and section being bent rotate with respect to a fixed set of outside formers. Similarly the rollers or other means for exerting pressure may be mounted on a rotating arm or urged into position in other To speed the rate at which sections can be bent, two pairs of outside formers 53 could be located to allow bending to proceed around the inside former 50 in opposite directions and simultaneously.

Figure 6:
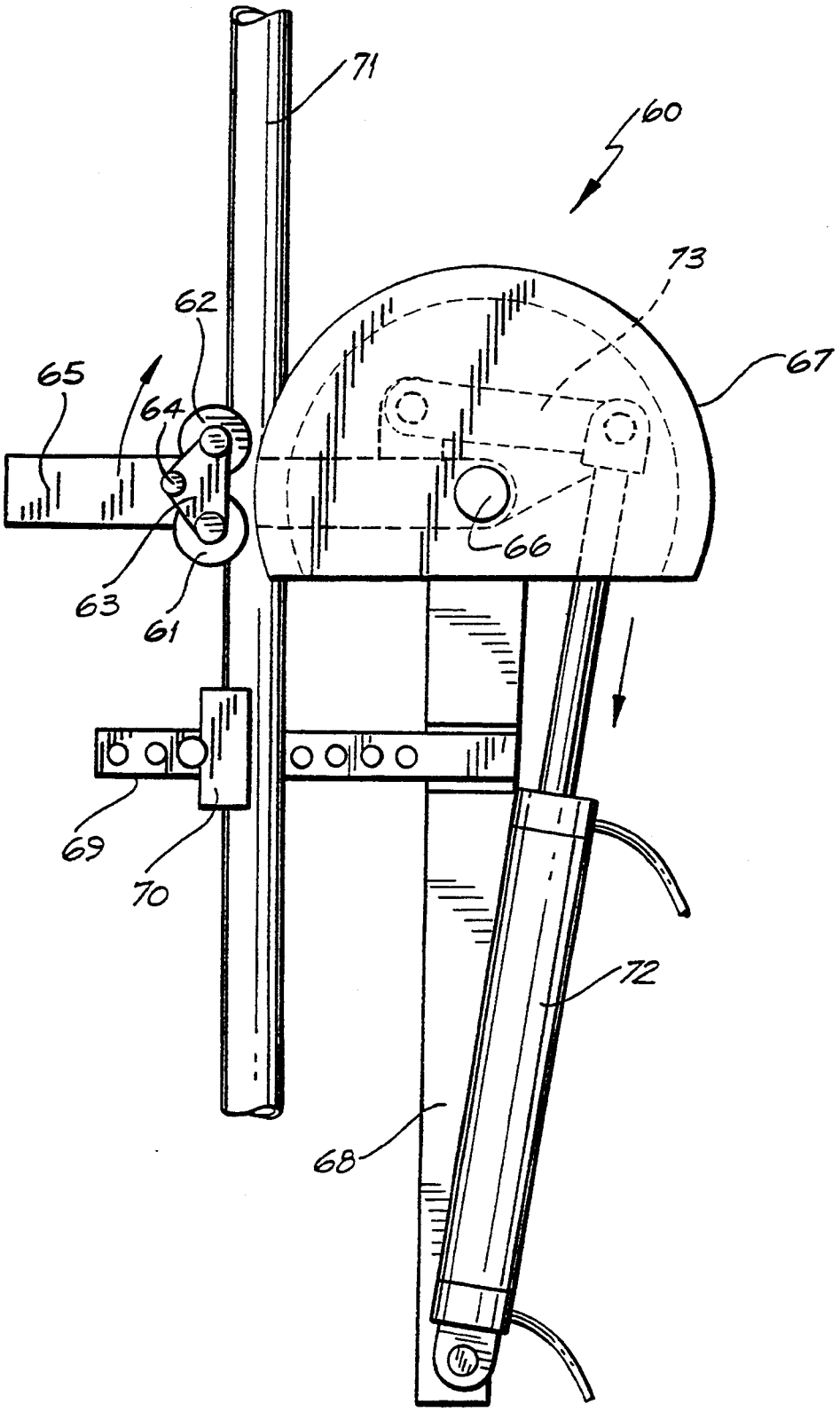
FIG. 6 is a front elevation of a bending apparatus incorporating a tandem roller arrangement.
Figure 7:
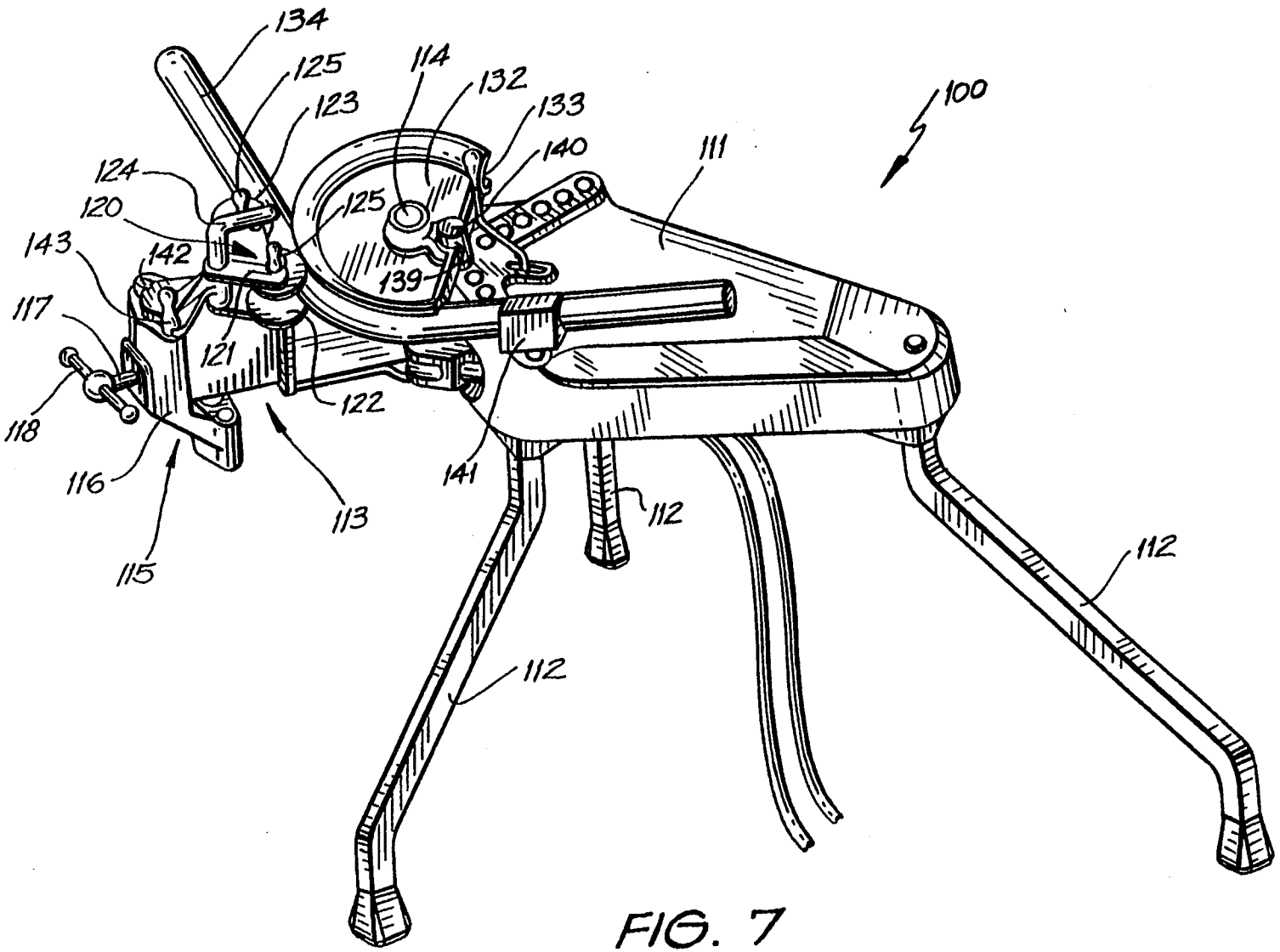
FIG. 7 is a schematic perspective view of a pipe bender.
Figure 8:
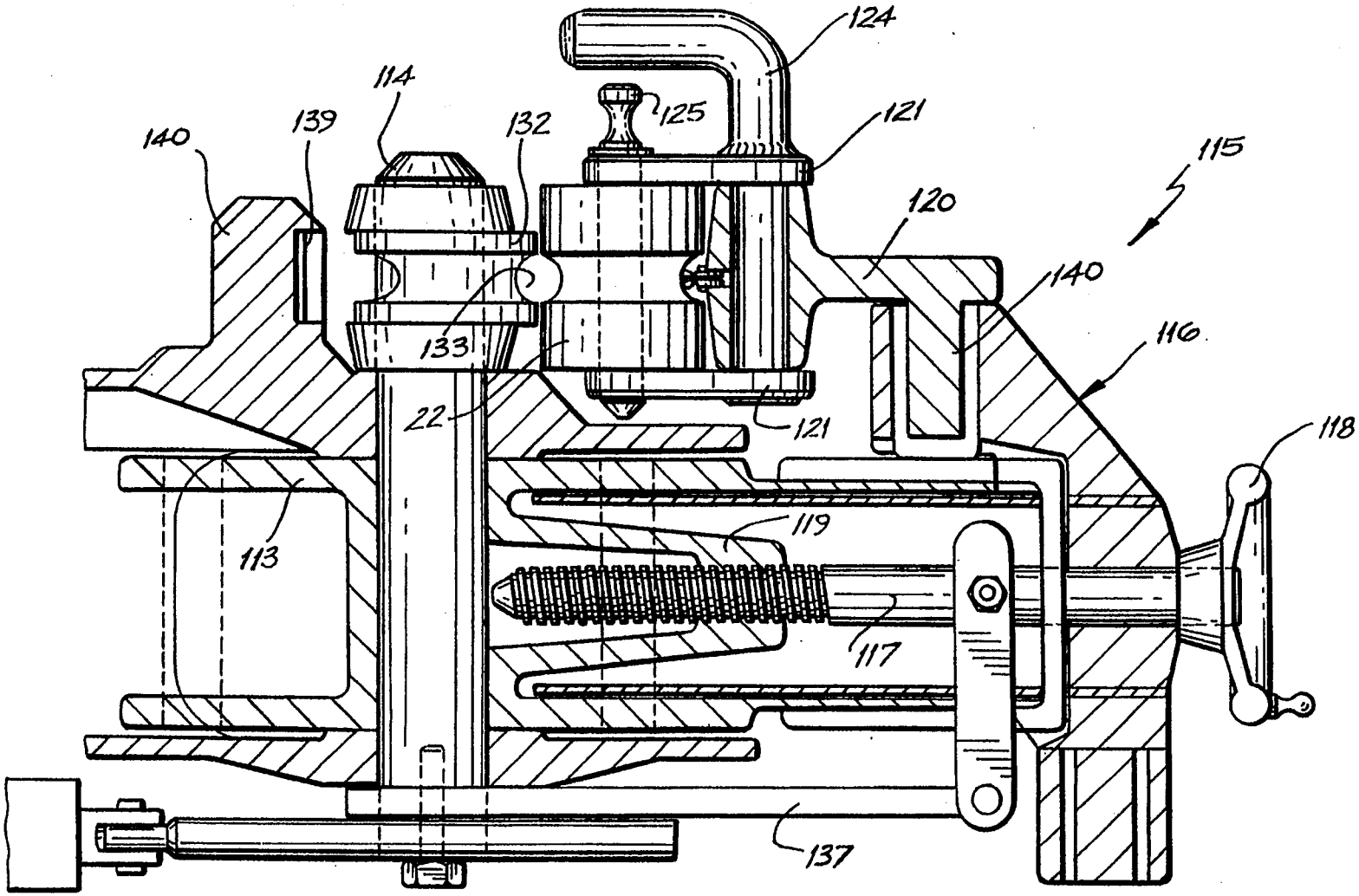
FIG. 8 is a schematic sectioned side elevation of a portion of the pipe bender of FIG. 7.
Figure 9:
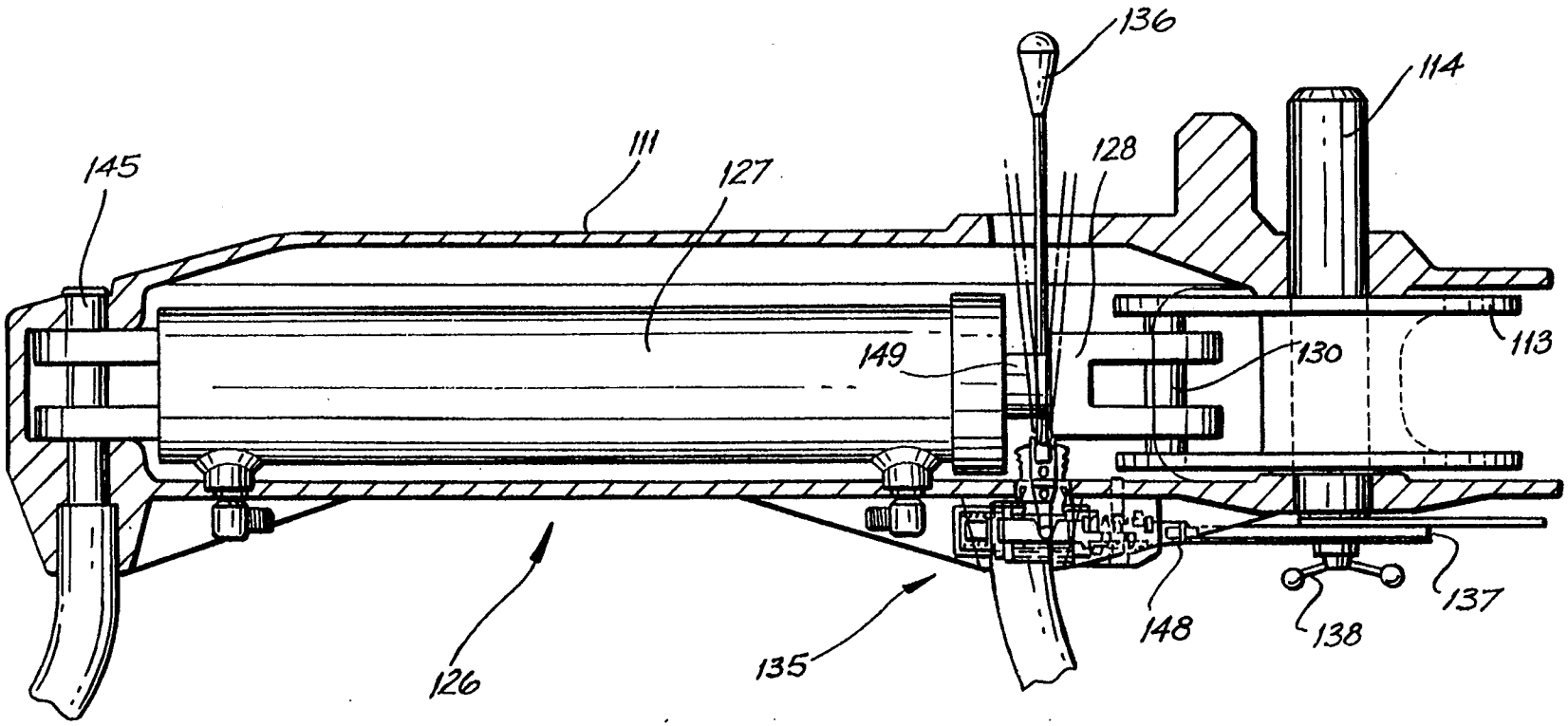
FIG. 9 is a schematic sectioned side elevation of the pipe bender of FIG. 7.

FIG. 6 illustrates an example of a pipe bending apparatus 60 utilizing tandem rollers 61 and 62. Note that the rollers 61 and 62 are mounted on a common cradle 63 which rotates about a pivot axis 64. The cradle 63 pivots with respect to an arm 65 which rotates about the centre 66 of the inside former 67. A central post 68 to which the inside former 67 is mounted also bears an arm 69 which provides a fixed reaction point 70 for the material which is being bent 71. A hydraulic cylinder 72 in combination with a link mechanism 73 allows the arm 65 to be rotated at least 180° with respect to the inside former. This particular arrangement for rotating the arm 65 is described more completely in Australian Patent Application No. 58906/90.

In FIGS. 7 to 13 of the accompanying drawings there is schematically depicted a pipe bender 100. The bender 100 has a base 111 from which there extends legs 112 to support the base 111 on a ground surface. The base 111 is basically a hollow housing which pivotally supports an arm 113 for pivotting movement about a generally vertical axis defined by the main pin 114.

Mounted on the radial extremity of the arm 113 is a bending assembly 115 which includes a carriage 116. The carriage 116 is slidably mounted on the arm 113 for longitudinal movement relative thereto. This movement is effected by means of a threaded shaft 117 provided at its outer end with an adjustment wheel or lever 118. The shaft 117 threadably engages a threaded passage 119 formed in the arm 113.

The bending assembly 115 further includes a roller support 120 pivotally mounted by means of a secondary pin 140. The support 120 co-operates with a pair of vertically spaced generally horizontal flanges 121 to support two or more rollers. In this particular embodiment two rollers 122 and 123 are provided. The flanges 121 are joined by means of a handle 124 which is pivotally supported by passing through a passage in the support 120. The rollers are each supported by means of a pin 125.

The roller 122 is positioned at the point of bending and the roller 123 is positioned forward thereof. The roller 123 is located angularly forward of and radially further out than the roller 122, relative to the bending axis.

Mounted within the base 111 is a hydraulic ram 126 having a cylinder 127 pivotally mounted at one end by means of a pin 145. The ram 126 has a piston rod 149 terminating with a yolk 128. The yolk 128 is pivotally attached to a link 129 by means of a pin 130. The other end of the link 129 is pivotally attached to the arm 113 by means of a pin 131. The arm 113 is also provided with an abutment means or socket 146 which receives the pin 130 during various phases of movement of the arm 113 about the pin 114.

Also mounted on the base 111 is a former 132 which is provided with a former surface 133 which extends angularly about the pin 114, at a generally constant radius. In this particular embodiment, the former surface 132 is concave in transverse cross-section. In this regard it should be appreciated that a length of pipe 134 is deformed to generally conform to the surface 132 and therefore the pin 114 also defines the bending axis about which the pipe 134 is bent.

Figure 10:
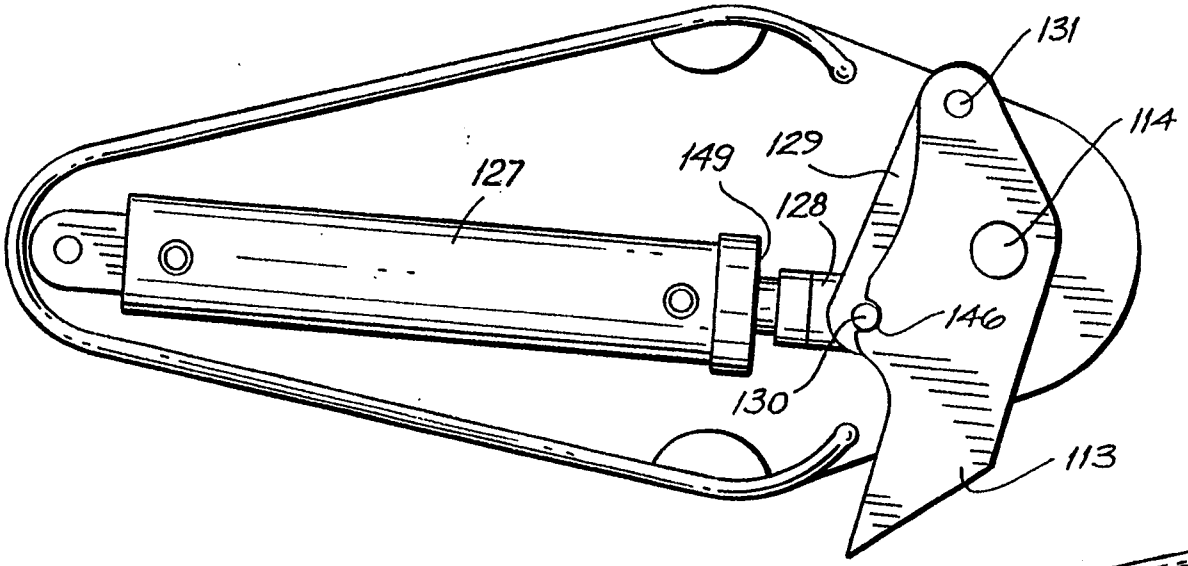
FIGS. 10 to 13 are schematic plan views of the pipe bender of FIG. 7 in progressive modes of operation.
Figure 11:
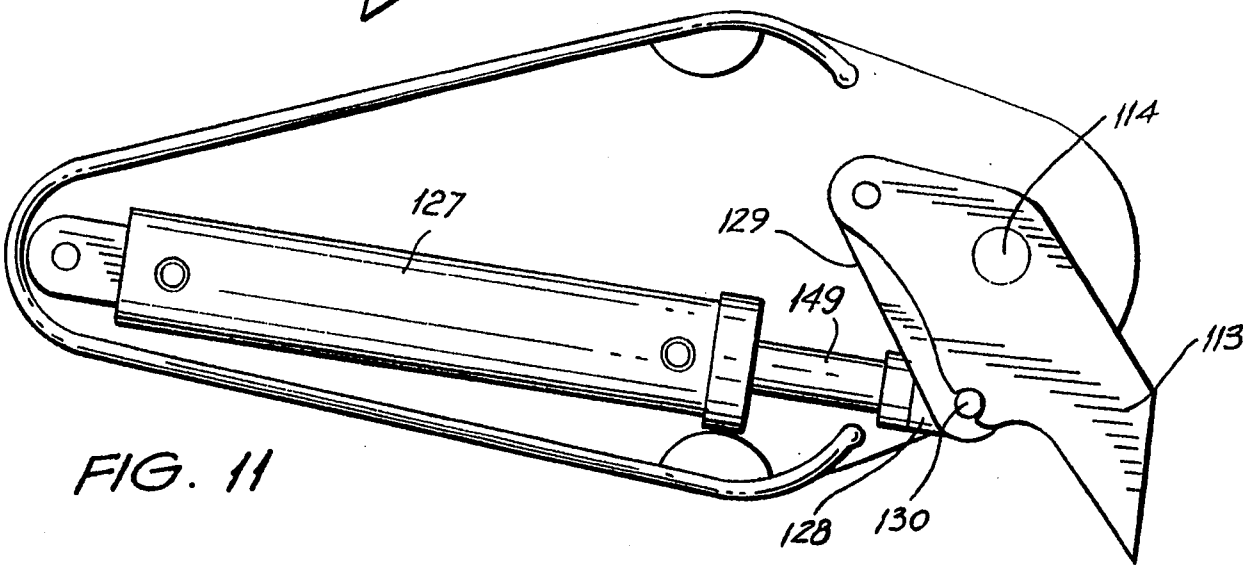
Figure 12:
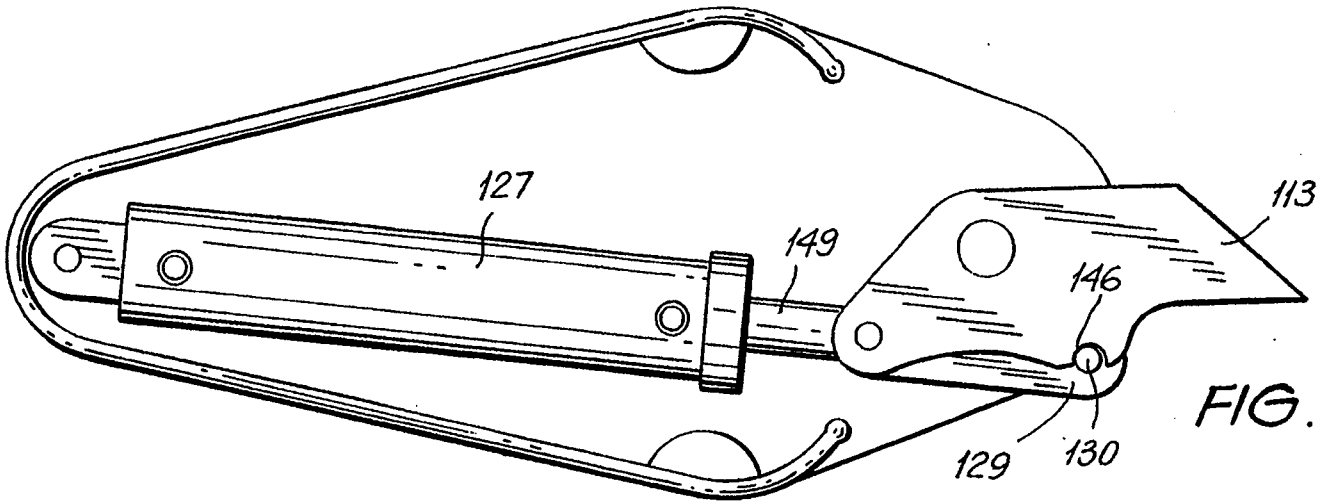
Figure 13:
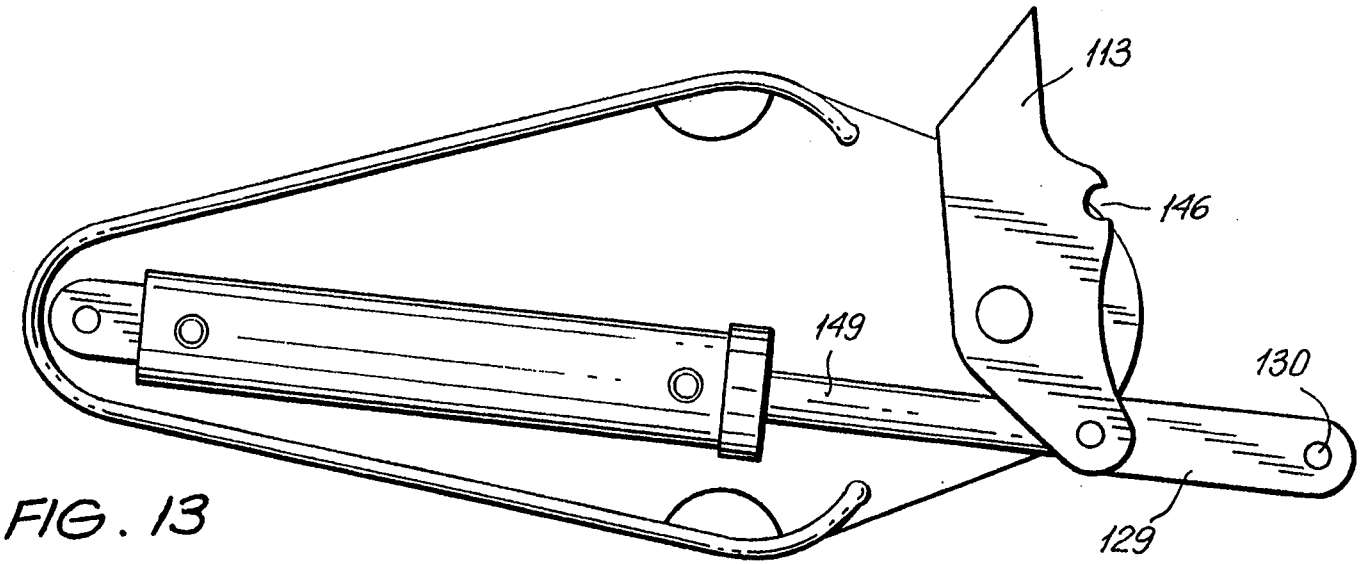

The hydraulic ram 126 is controlled in its movement by means of a spool valve 135, operated by means of a lever 136 extending upwardly through the base 111. The spool valve 135 receives hydraulic fluid under pressure and delivers it to the cylinder 127. When the spool valve 135 is moved in a first direction by means of the lever 136, hydraulic fluid under pressure is delivered to the cylinder 127 to cause the piston rod 149 to telescopically extend from within the cylinder 127. This telescopic movement commenced from when the hydraulic ram 126 is configured as shown in FIG. 10. As the piston rod 149 extends, the arm 113 is caused to pivot due to engagement of the pin 130 with the socket 146. This continues until the arm 113 has reached the position depicted in FIG. 12. At this position, the arm 113 pivots to remove the pin 130 from contact within the socket 146. However the arm 113 continues to pivot due to the force being applied to the arm 113 via the link 129.

The spool valve 135 has a cam follower 148 which engages a cam 137 fixed to the arm 113 (via the pin 114) so as to rotate with the arm 113. The cam 137 is adjustable to return the spool valve 135 to the start position and/or to cause the spool valve 135 to return the arm 113 to the start position. Accordingly, the cam 137 can be used to govern the angle through which the pipe 134 is bent.

The former 132 is mounted on the pin 114 but is removable. This enables formers of various sizes to be used so that varying radii may be produced. The former 132 has a rear recess 139 which engages a pin 140 on the base 111, so that the former 132 is held stationary during operation.

Also mounted on the base 111 is a pipe support 141 which engages the pipe 134 to retain one portion stationary with respect to the base 111 during bending.

It should be appreciated that the bender 100 is described as bending in one predetermined direction.

However it should be appreciated that bending can take place in the reverse direction. This is achieved by removing the former 132. Thereafter, the lever 136 is removed together with the cam 137 by release of the bolt 138. The handle 118 is then rotated to remove the bending assembly 115. Next the main pin 114 is removed which enables the arm 113 to be pulled from within the base 111. This is achieved by telescopic movement of the piston rod 149 outwardly with respect to the cylinder 127. Thereafter, the arm 113, link 129 and piston rod 127 are rotated about the axis of the piston rod 149, through 180°. Thereafter, the above steps are reversed. This then locates the hydraulic ram 126 and link 127 on the other side of the lever 136. The bender 110 will then operate to move the arm 113 clockwise about the pin 114 as opposed to anti-clockwise as described with reference to FIGS. 10 to 13. To accommodate the reverse movement, there is provided a pin 143 which is locatable in either of recesses 142 to hold the support 120 in the correct position.

It should be appreciated that the handle 118 is rotated in order to move the rollers 122 radially with respect to the pin 114, in order to accommodate pipes of different diameters. It should further be appreciated that two or more rollers 122 may be employed, with one of the rollers being positioned at the point of deformation of the pipe 134.

While the present invention has been described with reference to particular details of construction, it should be appreciated that the teachings of the present invention have been provided by way of specific examples which should not be construed as limitations to the scope or spirit of the invention.

I claim:

1. A pipe bender comprising:

a base;

a former mounted on the base and having a former surface extending angularly at a fixed radius about a bending axis, said former surface being provided to engage a length of pipe to be bent to conform to at least a portion of the length of said former surface;

a bending arm pivotally mounted on said base for pivoting movement about said bending axis;

a bending assembly mounted radially of said bending axis on said arm, said assembly including a roller support pivotally mounted on the bending arm and having two deforming rollers rotatably mounted thereon, said support being mounted for movement about a support axis parallel to said bending axis and spaced radially outwardly of said surface, said rollers being adapted to engage said length of pipe to cause bending thereof at a point along the pipe as the bending assembly is moved angularly about said bending axis;

said rollers each having a rotational axis which is parallel to said bending axis, the rotational axes being spaced a predetermined distance, said rollers being substantially coextensive with one roller being positioned radially with respect to said bending axes so that in use said one roller is positioned at approximately said point, the other roller being spaced angularly forward of said one roller thereby permitting in combination with the pivoting of said support, the predetermined distance said rotational axes are spaced and the pivoting of said support about said support axis, positioning of said other roller radially further from said bending axis than said one roller so that said one roller is positioned at said point of said bending;

a hydraulic ram pivotally mounted on said base and pivotally connected to said arm to cause angular movement of said arm about said bending axis to thereby move said roller to deform said pipe; and a reaction member mounted on said base and adapted to engage said length of pipe during bending thereof and to retain a bent portion of said length of pipe in contact with said former surface.

2. The pipe bender of claim 1 wherein said bending arm comprises means for selecting a radial location of the bending assembly relative to said surface.

3. The pipe bender of claim 1 wherein said two deforming rollers are rotatably mounted upon a flange which is pivotally supported by said bending arm.

4. The pipe bender of claim 1 wherein said other end of the hydraulic ram is pivotally connected to a link by way of a pin, the link in turn being pivotally connected to the bending arm and wherein said pin is adapted to form contact within a socket of the bending arm during at least a portion of pivotal rotation of said bending arm.

5. The pipe bender of claim 1 wherein the former is removable so as to be replaced by formers of varying radii.

6. The pipe bender of claim 1 wherein the former comprises a recess adapted to cooperate with a projection on the base to hold said former stationary relative to the base during operation.

7. A pipe bender comprising:

a base;

a former mounted on the base and having a former surface extending angularly at a fixed radius about a bending axis, said former surface being provided to engage a length of pipe to be bent to conform to at least a portion of the length of said former surface;

a bending arm pivotally mounted on said base for pivoting movement about said bending axis;

a bending assembly mounted on said arm, said assembly including roller means rotatably mounted for movement about an axis parallel to said bending axis, and spaced radially outwardly of said surface, said roller means being adapted to engage said length of pipe to cause bending thereof as the bending assembly is moved angularly about said bending axis; and a hydraulic ram privotally mounted on said base and pivotally connected to said arm to cause angular movement of said bending arm about said bending axis to thereby move said roller means to deform said pipe;

a link pivotally attached to said bending arm for pivoting movement relative thereto about a second pivot axis parallel to said bending axis;

an hydraulic actuator operatively extending between the base and bending arm to cause pivoting movement therebetween about said bending axis, said hydraulic actuator being attached to said link at a predetermined location, which location moves along an arcuate path about said second axis upon pivoting of said link relative to said bending arm; and an abutment on the bending arm positioned along said path to engage and limit the angle through which said link can pivot relative to said bending arm, said abutment being positioned angularly relative to said bending axis and second axis so that said link pivots with said bending arm in predetermined direction through a first angle to cause pivoting of said bending arm until a predetermined angular position of said abutment is reached whereat said link is permitted to pivot relative to said bending arm and to cause further pivoting of said bending arm about said bending axis.

8. The pipe bender of claim 7 wherein the actuator has a cooperating piston, cylinder and piston rod, said rod having a longitudinal axis, and the bending arm, link and a piston rod are rotatable about the longitudinal axis of the piston rod through 180°.

9. A pipe bender comprising:

a base;

a former mounted on the base and having a former surface extending angularly at a fixed radius about a bending axis, said former surface being provided to engage a length of pipe to be bent to conform to at least a portion of the length of said former surface;

a bending arm pivotally mounted on said base for pivoting movement about said bending axis;

a bending assembly mounted on said arm, said assembly including roller means rotatably mounted for movement about an axis parallel to said bending axis, and spaced radially outwardly of said surface, said roller means being adapted to engage said length of pipe to cause bending thereof as the bending assembly is moved angularly about said bending axis;

a link pivotally attached to said bending arm for pivoting movement through an angle relative thereto about a second pivot axis parallel to said bending axis;

a hydraulic ram to cause angular movement of said bending arm about said bending axis to thereby move said roller means to deform said pipe, said ram having a piston rod with a longitudinal axis, said hydraulic ram being pivotally attached to said base and pivotally attached to said link at a predetermined location, which location moves along an arcuate path about said second axis upon pivoting of said link relative to said bending arm;

an abutment on the bending arm positioned along the path to engage and limit the angle through which said link can pivot relative to said bending arm, said abutment being positioned angularly relative to said bending axis and said second axis so that said link pivots with said bending arm in a predetermined direction through a first angle to cause pivoting of said bending arm until a predetermined angular position of said abutment is reached whereat said link is permitted to pivot relative to said bending arm to cause further pivoting of said bending arm about said bending axis; and wherein the bending arm and rod are adapted to be rotated about the longitudinal axis of the rod through 180° so as to allow the pipe bender to operate in a reverse direction.

* * * * *